US005954555A

United States Patent [19]

Ozawa et al.

[11] Patent Number: 5,954,555

[45] Date of Patent: Sep. 21, 1999

[54] OIL SUPPLY SYSTEM FOR PERSONAL WATERCRAFT

[75] Inventors: Sigeyuki Ozawa; Ryoichi Nakase, both of Iwata, Japan

[73] Assignee: Yamaha Hatsudoki Kabushiki Kaisha, Iwata, Japan

[21] Appl. No.: 09/045,840

[22] Filed: Mar. 20, 1998

Related U.S. Application Data

[63] Continuation of application No. 08/999,501, Dec. 29, 1997.

[51] Int. Cl.[6] ..... B63H 21/32

[52] U.S. Cl. ..... 440/89; 123/65 PE

[58] Field of Search ..... 440/88, 89; 184/6, 184/6.5, 6.9; 123/196 R, 323, 65 PE; 60/324

[56] References Cited

U.S. PATENT DOCUMENTS

| | | | |
|---|---|---|---|
| 4,399,788 | 8/1983 | Bostelmann | 123/323 |
| 4,730,580 | 3/1988 | Matsushita | 123/196 R |
| 5,195,481 | 3/1993 | Oyama et al. | 123/196 R |
| 5,400,755 | 3/1995 | Maebashi | 123/339 |
| 5,536,189 | 7/1996 | Mineo | 114/270 |
| 5,738,073 | 4/1998 | Koike et al. . | |
| 5,782,214 | 7/1998 | Nanami et al. | 123/65 PE |
| 5,827,096 | 10/1998 | Mineo | 440/89 |

*Primary Examiner*—Sherman Basinger

*Attorney, Agent, or Firm*—Knobbe, Martens, Olson & Bear LLP

[57] ABSTRACT

An oil supply system for a watercraft is disclosed. The watercraft has a water propulsion device and a hull defining an engine compartment, an internal combustion engine positioned in the engine compartment and having an output shaft arranged to power the water propulsion device. The engine has at least one combustion chamber and an intake and exhaust path including an air intake system through which air is provided to the combustion chamber(s) and an exhaust system for routing products of combustion from the combustion chamber(s) to a discharge, the exhaust system including a water lock between the discharge and the engine. The engine also includes a fuel supply system supplying fuel to the combustion chamber(s) for combustion with the air. The oil supply system is arranged to introduce lubricant to the engine along the intake and exhaust path upstream of the water lock.

5 Claims, 14 Drawing Sheets

OIL SUPPLY SYSTEM FOR PERSONAL WATERCRAFT

RELATED APPLICATIONS

This application is a continuation of U.S. patent application Ser. No. 08/999,501, filed Dec. 29, 1997

FIELD OF THE INVENTION

The present invention relates to a lubricating system for an internal combustion engine. More particularly, the present invention relates to an oil or lubricating system which supplies oil to an engine powering a watercraft, the oil supplied upstream of an exhaust waterlock of the engine.

BACKGROUND OF THE INVENTION

Watercraft such as those known as "personal watercraft" have a hull which defines an engine compartment, and include a water propulsion device. An internal combustion engine is positioned in the engine compartment. An output shaft of the engine is arranged to drive the water propulsion device.

An air intake system provides air to the engine for use in the combustion process. The portion of the intake system associated with the engine draws air from within the engine compartment and delivers it to each combustion chamber thereof. The portion of the intake system associated with the watercraft includes one or more air passages leading from a point external to the hull through the hull into the engine compartment.

In addition, the watercraft includes a fuel system for supplying fuel to each combustion chamber of the engine. The fuel system includes a fuel tank positioned in the hull of the watercraft and a fuel pump delivering fuel from the tank to at least one charge former, such as a full injector, which introduces fuel to the engine.

Because the watercraft is operated in the water, water often enters the engine compartment through the air passages through the hull. This water may damage sensitive components, such as the fuel injector(s). In addition, water may be drawn directly into the air intake of the engine. When a throttle valve is positioned in the intake system of the engine, this water may cause the valve to corrode and stick, preventing it from operating properly.

In addition, the engine has an exhaust system associated therewith. Exhaust is routed from the engine through the exhaust system to a point external to the watercraft, typically into the body of water in which the watercraft is operating. In order to prevent the flow of water back through the exhaust system to the engine, a water lock is positioned between the discharge point and the engine. Because the water lock must handle hot exhaust, it is constructed of metal. Because the water lock is exposed to water, however, corrosion often significantly shortens the life of this component.

A watercraft arranged to overcome the above-stated problems is desired.

SUMMARY OF THE INVENTION

In accordance with the present invention there is provided an oil supply system for an internal combustion engine powering a water propulsion device of a watercraft.

The watercraft has a water propulsion device and a hull defining an engine compartment, an internal combustion engine positioned in the engine compartment. The engine has an output shaft arranged to power the water propulsion device.

The engine has at least one combustion chamber and an intake and exhaust path including an air intake system through which air is provided to the combustion chamber(s) and an exhaust system for routing products of combustion from the combustion chamber(s) to a discharge, the exhaust system including a water lock between the discharge and the engine. The engine also includes a fuel supply system supplying fuel to the combustion chamber(s) for combustion with the air.

In accordance with the present invention, the oil supply system is arranged to introduce lubricant to the engine along the intake and exhaust path upstream of the water lock. In this manner, lubricant flows through the engine, including the exhaust system, to the water lock for lubricating the interior of the water lock and protecting it from corrosion.

In a preferred embodiment of the invention, the intake system of the engine includes a throttle passage having a throttle valve positioned therein and the lubricant is delivered upstream of the throttle valve for lubricating the throttle valve.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
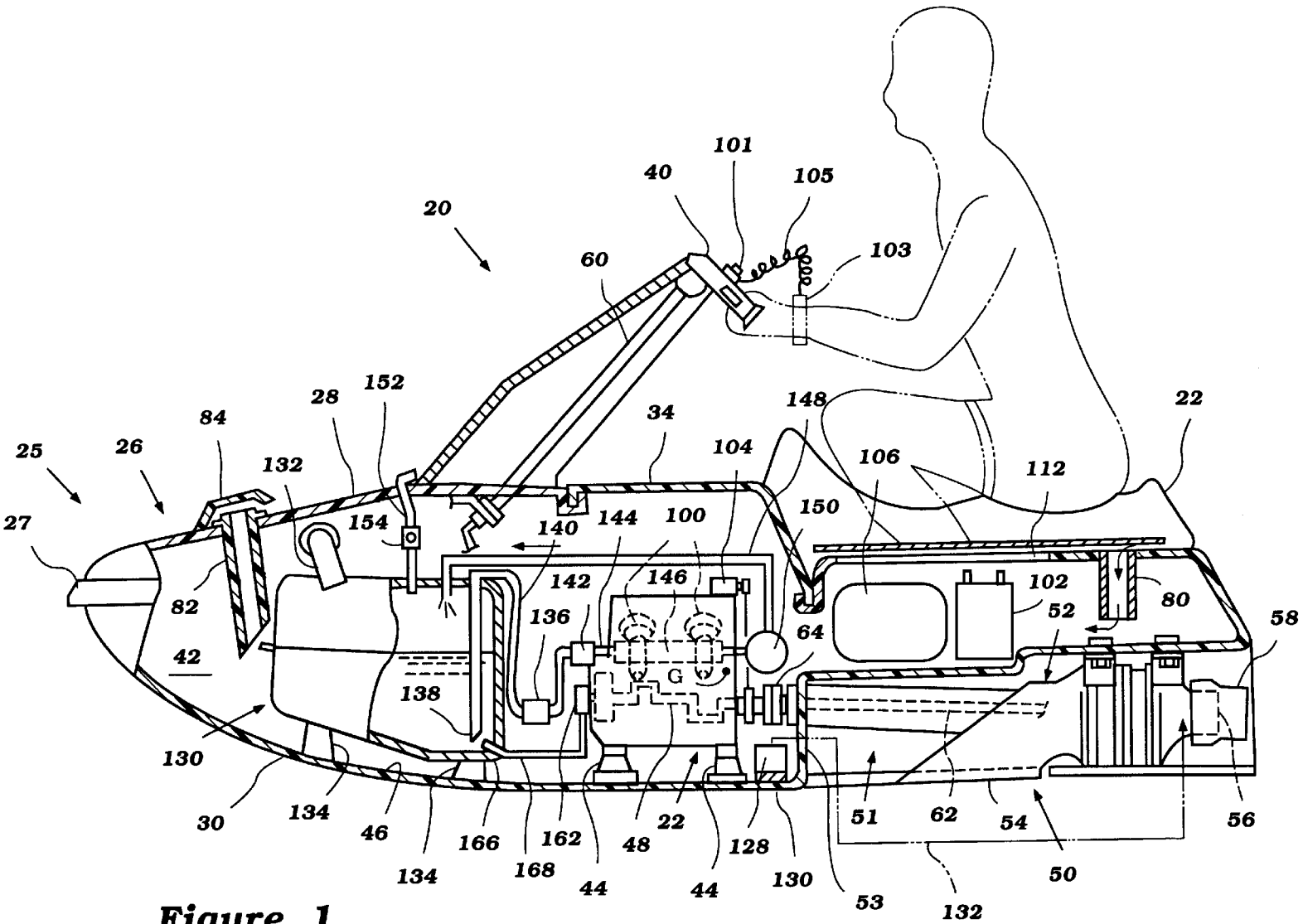
FIG. 1 is a cross-sectional side view of a watercraft powered by an engine and having an oil supply system in accordance with a first embodiment of the present invention.

FIGS. 1–4 illustrate a watercraft 20 having an oil supply system in accordance with a first embodiment of the present invention. The terms "oil" and "lubricant" (and variations thereof are used interchangeably herein, and are intended to mean a lubricant material such as natural petroleum oil, synthetic oil and other materials as known to those skilled in the art for use in lubricating an engine and serving as a corrosion protectant.

As illustrated, the watercraft 20 generally comprises a watercraft body 25 having an engine 22 mounted therein for powering a water propulsion device. The watercraft body 25 preferably comprises a hull 26 having a top portion or deck 28 and a lower portion 30. A gunnel 27 defines the intersection of the deck 28 and the lower portion 30 of the hull 26.

In addition, the body 25 includes a seat 32 positioned on the top portion 28 of the hull 26. A removable deck member 34 forms a part of the top portion 28 of the hull 26, the deck removable to provide access to the engine 22 positioned therebelow. A steering handle 40 is provided adjacent the seat 32 for use by a user in directing the watercraft 20 in a manner described in more detail below.

The top and bottom portions 28, 30 of the hull 26 cooperate to define an engine compartment 42. The engine 22 is positioned in the engine compartment 42. The engine 22 is connected to the hull 26 via several engine mounts 44 connected to a bottom 46 of the lower portion 30 of the hull 26. As described above, the engine 22 is preferably partially accessible through a maintenance opening which is formed by removal of the removable deck member 34.

The engine 22 has a crankshaft 48 arranged to drive a water propulsion device 50 of the watercraft 20. The water propulsion device 50 preferably comprises a propulsion passage 52 in which is positioned an impeller (not shown). The propulsion device 50 is preferably positioned in a propulsion compartment 51 which is defined by the lower portion 30 of the hull 26, including a wall section 53 thereof.

The propulsion passage 52 has an inlet 54 positioned in the bottom of the hull 26, and an outlet 56 facing a stem of the craft 20. The impeller is positioned in the passage 52 between the inlet 54 and outlet 56 and is driven by an impeller shaft 62. The impeller shaft 62 extends from the impeller through the wall 53 of the lower portion 30 of the hull 26 into the engine compartment 42. The impeller shaft 62 is driven by the crankshaft 48 of the engine 22 through a coupling 64.

A nozzle 58 is movably positioned at the outlet 56 of the passage 52 for directing water which is forced through the outlet. The nozzle 58 is connected to the steering handle 40 through a steering linkage 60 (only part of which is shown). In this manner, the operator of the craft 20 may direct the craft in different directions by directing the propelled water with the nozzle 58 by turning the steering handle 40.

Figure 2:
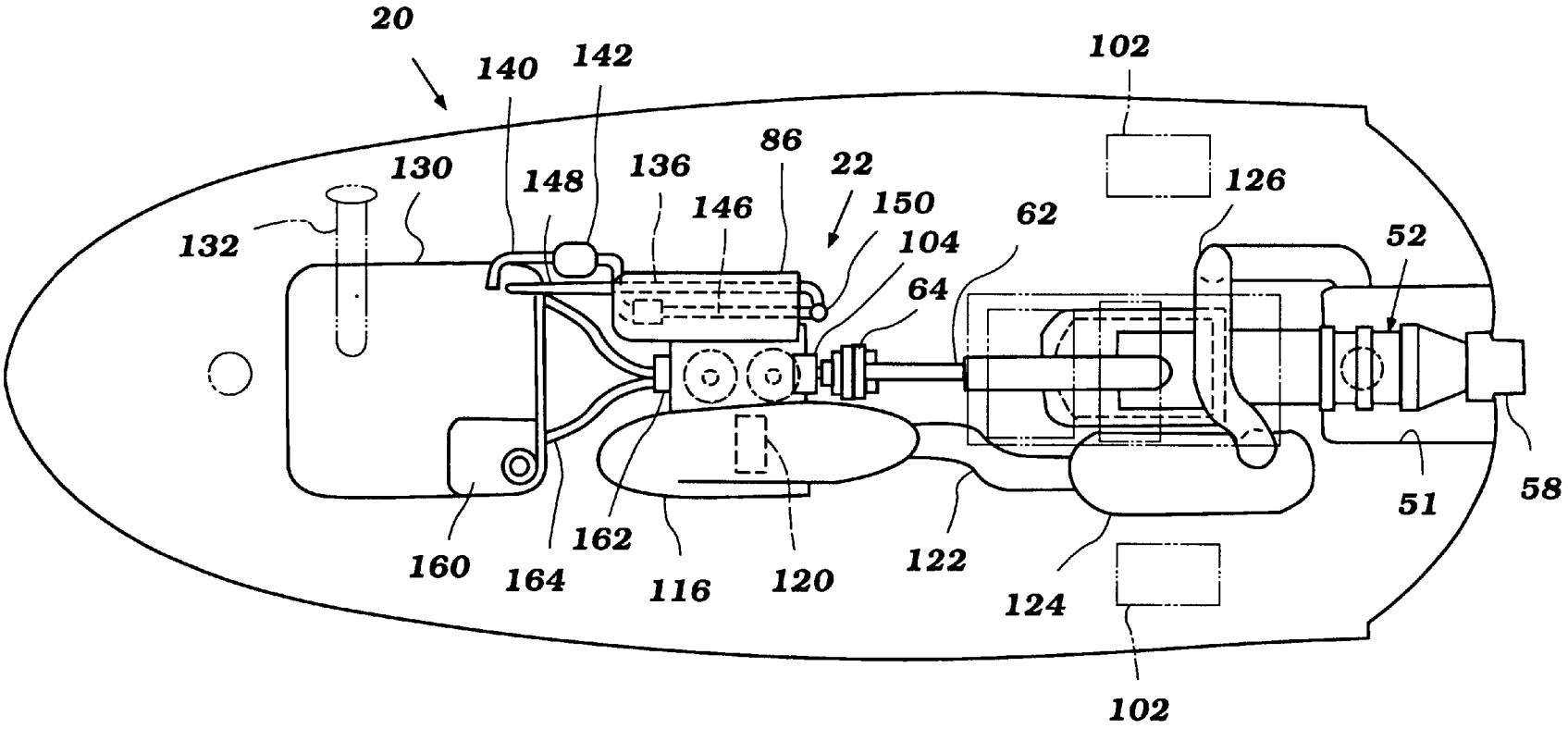
FIG. 2 is a top cross-sectional view of the watercraft illustrated in FIG. 1, exposing the engine and other internal features of the watercraft.
Figure 3:
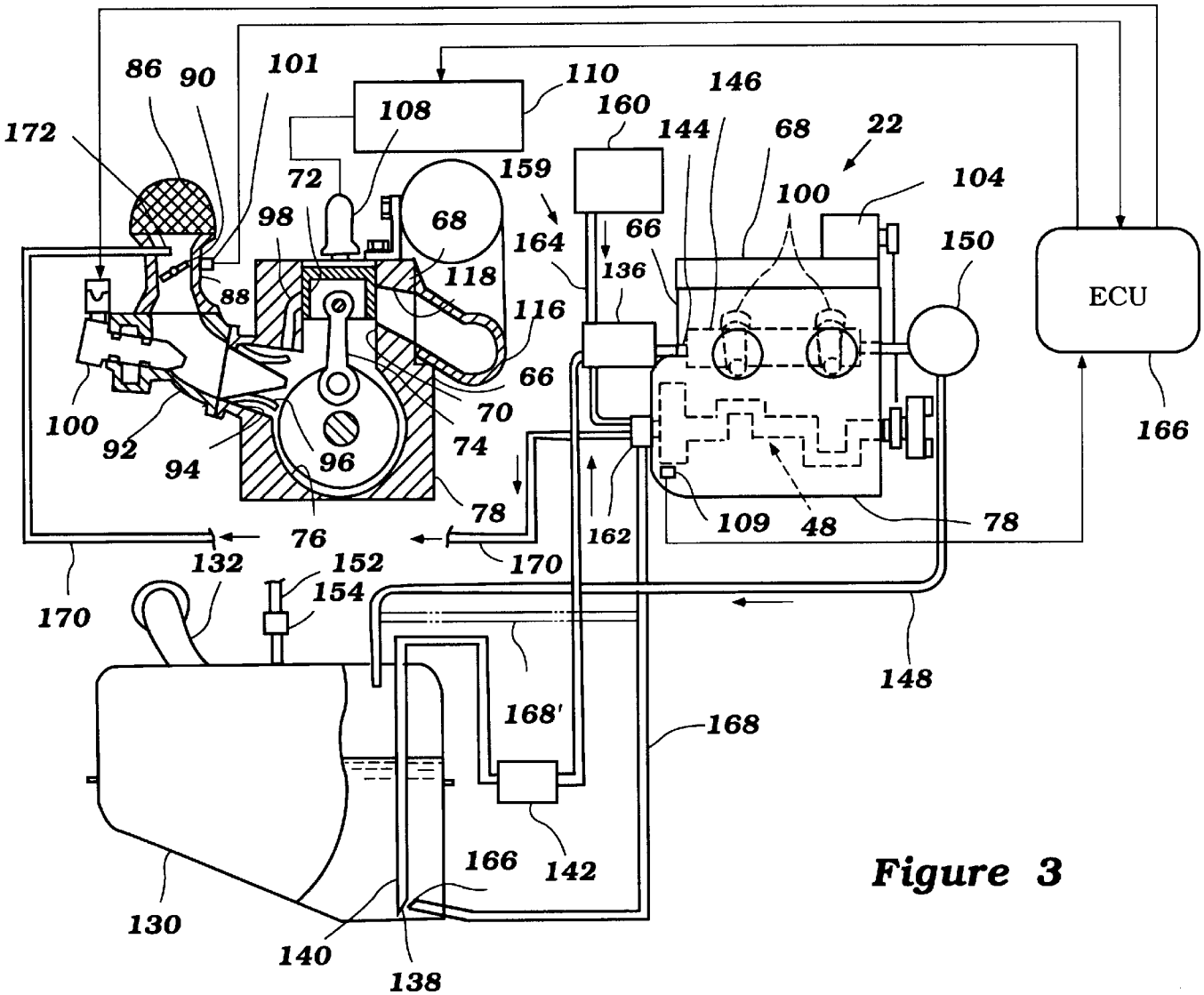
FIG. 3 is a schematic illustration of the oil supply system of the first embodiment of the present invention.

The engine 22 is best illustrated in FIGS. 1–3. As illustrated therein, the engine 22 is preferably of the two-cylinder variety, arranged in in-line fashion and operating on a two-cycle principle. Of course, the engine 22 may have as few as one, or more than two, cylinders, as may be appreciated by one skilled in the art.

The engine 22 includes a cylinder block 66 having a cylinder head 68 connected thereto and cooperating therewith to define two cylinders 70. A piston 72 is movably mounted in each cylinder 70 and connected to the crankshaft 48 via a connecting rod 74.

The crankshaft 48 is rotatably journalled with respect to the cylinder block 66 within a crankcase chamber 76. Preferably, the chamber 76 is defined by a crankcase cover member 78 which extends from a bottom portion of the cylinder block 66.

The engine 22 includes means for providing an air and fuel mixture to each cylinder 70 for combustion therein. Referring to FIG. 1, air is drawn in to the engine compartment 42 through a pair of air inlets 80, 82 in the hull 26. As illustrated, a front inlet 82 extends through the top portion 38 of the hull 26. To reduce the occurrence of water entering this inlet 82, a cover element 84 extends partially over the inlet 82. The other inlet 80 is positioned below the seat 32, with air drawn thereto through a space between the seat 32 and the top portion 28 of the hull 26.

Air within the engine compartment 52 is drawn through a filtered intake 86 into a throttle body 88. As illustrated in FIG. 3, a throttle valve 90 is movably positioned in the throttle body 88 for controlling the rate of air flow therethrough. The throttle valve 90 is preferably actuated by the operator of the watercraft 20 by a throttle control positioned on the steering handle 40.

An intake manifold 92 extends between the throttle body 88 and the engine 22. The intake manifold 92 defines a passage therethrough corresponding to each cylinder. Each passage through the manifold 92 leads to a corresponding intake passage 94 through the engine 22 into the crankcase chamber 76. The crankcase chamber 76 is divided into compartments corresponding to each cylinder 70. A reed-type valve 96 is positioned in each intake passage 94. The reed valve 96 is arranged to permit the flow of air into the crankcase 76 but prevent the flow of air out of the crankcase 76 in the direction of the manifold 92.

As is well known in the two-cycle engine art, the engine is arranged so that when the piston 72 moves upwardly, air is drawn through the intake system, including the reed valve 96 into the crankcase chamber 76. As the piston 72 moves downwardly, the air is compressed and eventually flows through a scavenge passage 98 leading into the portion of the cylinder 70 above the piston 72.

Preferably, fuel is provided to each cylinder 70 for combustion with the air. The fuel system will be described in more detail below, but preferably includes a fuel injector 100 which injects fuel into the air passing through the passage through the manifold 92.

An ignition system is provided for igniting the fuel and air charge which is supplied to the cylinder 70. Preferably, this ignition system includes a power source, such as a pair of batteries 102 (see FIG. 1) and/or a generator 104. An electronic engine control unit (ECU) 106 is arranged to fire an ignition element 108 corresponding to each cylinder 70 through an ignition coil 110.

The batteries 102 are positioned in the hull 26 of the craft 20 in an area below the seat 32, as is the ECU 106. Preferably, the seat 32 is removably connected to the top portion 28 of the hull 26 and positioned over an access opening 112 therein, permitting access to the batteries 102 and ECU 106 positioned therebelow.

In the preferred embodiment, each ignition element 108 preferably comprises a spark plug. A crankshaft sensor 109 preferably provides timing data to the ECU 106 for use in controlling the timing of the ignition of the spark plugs 108.

Referring to FIG. 1, the watercraft 20 preferably includes a lanyard switch 101 for controlling the ignition. As illustrated, the switch 101 is preferably mounted near the steering handle 40. The switch 101 includes a wrist band 103 which the operator of the watercraft 20 wears, and a cord 105 extending between the band 103 and the switch 101. The switch 101 is arranged so that in one position, the power is provided to the ignition circuit 110 and/or ECU 106, permitting the engine 22 to run, and in a second position when the cord 105 is pulled (such as when the operator of the craft 20 falls off) the switch prevents power from flowing to the ignition system and thus shuts off the engine 22.

Exhaust gas generated by the engine 22 is routed from the engine to a point external to the watercraft 20 by an exhaust system which includes an exhaust manifold 116. Exhaust from each cylinder 70 is preferably expelled therefrom to the exhaust manifold 116 through an exhaust passage 118 extending through the cylinder head 68. An exhaust timing valve may be provided in the passage 118 for controlling the timing of the opening and closing of the passage 118, as is well known to those of skill in the art.

As best illustrated in FIG. 2, the exhaust manifold 116 extends towards a front end of the engine 22, before looping back to an expanded portion which extends along a top of the engine towards the rear of the watercraft 20. A catalyst 120 is preferably positioned in this expanded portion of the manifold 116.

The manifold 116 leads to an upper exhaust pipe 122. This upper exhaust pipe 122 leads to a water lock 124, as well known in the art, and thereon to a lower exhaust pipe 126. The second portion of the exhaust pipe 126 terminates in the propulsion compartment 51, where the exhaust gases from the engine 22 are discharged. Because the water lock 124 is subject to high temperature exhaust gas, the water lock 124 is preferably constructed of a metal such as aluminum.

Preferably, the watercraft 20 includes a bilge 128 positioned at the bottom 46 of the hull 26 within the engine compartment 42. The bilge 128 has a pump arranged to draw liquid through a screened inlet 130 and discharge the liquid through a discharge line 132 which extends to the propulsion compartment 51.

The fuel system will now be described in more detail in conjunction with FIGS. 1–3. As illustrated, the fuel system includes a fuel supply. Preferably, this supply comprises fuel within a tank 130. As illustrated, the tank 130 is positioned in the engine compartment 42, forward of the engine 22 towards the front of the craft 20. The tank 130 is preferably supported above the bottom surface 46 of the lower portion 30 of the hull 26 by several legs or supports 134.

A fill spout 132 extends from the tank through the upper portion 28 of the hull 26. A user of the craft 20 may fill the tank 130 with fuel through the spout 132.

Means are provided for delivering fuel from the tank 130 to the engine 22. Preferably, this means comprises a fuel pump 136. The pump 136 may be of a variety of types as known to those of skill in the art, but is preferably electrically powered. The pump 136 draws fuel from the tank 130 through an inlet 138 of a delivery line 140. Preferably, as illustrated in FIG. 3, the inlet 138 of the delivery line 140 is positioned near a bottom of the tank 130 in a portion of the tank 130 closest to the engine 22.

The pump 136 preferably delivers fuel through a filter element 142 positioned along the line 140, and thereafter through a high pressure line 144 extending to a fuel rail 146. The fuel injectors 100 are connected to the fuel rail 146, whereby fuel at high pressure is delivered to the injectors 100.

Preferably, as also illustrated in FIG. 3, each injector 100 is of the electrically-actuated type. In this arrangement, the ECU 106 is arranged to control the timing of the injectors 100 turning on and off, and thus the timing of the injection of the fuel by each injector 100. A throttle position sensor 101 provides throttle valve 88 position data to the ECU 106. The ECU 106 preferably utilizes this information to control the duration of the fuel injection.

Fuel which is supplied to the injectors 100 through the fuel rail 146 but not delivered by the injectors 100 to the engine 22 is preferably routed back to the fuel tank 130. As illustrated, a return line 148 extends from an end of the fuel rail 146 opposite the end the high pressure delivery line 144 is connected to. This return line 148 extends to the fuel tank 130. Preferably, a control valve 150 is positioned along the return line 148. The valve 150 is arranged to maintain the pressure within the fuel rail 146 at a high pressure, and yet allow excess fuel to return to the tank 130.

A vapor relief line 152 preferably extends from the tank 130 through the upper portion 28 of the hull 26 for routing vapor from within the tank 130 to a point external to the watercraft 20. A roll-over valve 154 is positioned along the line 152 for preventing fuel from draining from the tank 130 through the line 152 in the event the watercraft 20 flips upside down.

The engine 22 includes an oil supply system 159 for providing lubricating oil to the engine. The oil supply system 159 preferably includes lubricant or oil supply. In the embodiment illustrated in FIGS. 1–3, the oil supply preferably comprises oil positioned in an oil tank 160 which is formed as a corner portion of the fuel tank 130. This arrangement permits the fuel and oil tanks 130, 160 to comprise a single integral member, reducing manufacturing and assembly costs.

Means are provided for delivering lubricant from the tank 160. Preferably, this means comprises an oil pump 162. As illustrated, the pump 162 is preferably positioned at an end of the crankshaft 48 at the front end of the engine 22 (i.e., at the end opposite the end of the crankshaft 48 which is coupled to the impeller shaft 62) and driven by the crankshaft.

As is common in the two-cycle engine art, the oil pump 162 is arranged to deliver oil into the fuel for mixing therewith, whereby the fuel injectors 100 deliver a fuel and oil mixture. As illustrated, the oil pump 162 draws oil from the tank 160 through a supply line 164 and delivers it through an outlet 166 of a first delivery line 168 which extends to the fuel tank 130. Preferably, the outlet 166 of the line 168 is positioned near the inlet 138 of the fuel line 140.

In accordance with the present invention, the oil pump 162 is also arranged to deliver oil directly into the engine 22 along the intake/exhaust path therethrough upstream of the water lock 124 of the exhaust system. In the preferred embodiment, the oil pump 162 delivers oil through a second delivery line 170 which terminates at an outlet 172 positioned in the throttle body 88 upstream (i.e., close to the silencer 86) of the throttle valve 90.

In this arrangement, oil supplied into the throttle body 88 lubricates the throttle valve 90, preventing it from corroding and sticking and the like. In addition, the lubricant lubricates the fuel injectors 100.

In an alternate arrangement of this embodiment illustrated in FIG. 3, the oil supply line 168' may extend to the fuel return line 148 instead of directly to the fuel tank 130. In this manner, the oil is mixed with the returned fuel.

Referring to FIG. 1, the watercraft 20 has a center of gravity G. In the first embodiment of the present invention, the oil inlet 166 is positioned in the fuel tank 130 in a position which is offset from the center of gravity G. In particular, the inlet 166 is offset longitudinally (i.e., in a front-to-rear direction of the watercraft 20) from the center of gravity G. In this arrangement, the oil which is supplied to the fuel in the fuel tank 130 is mixed partly by the pitching motion of the watercraft 20 about its center of gravity G.

Figure 4:
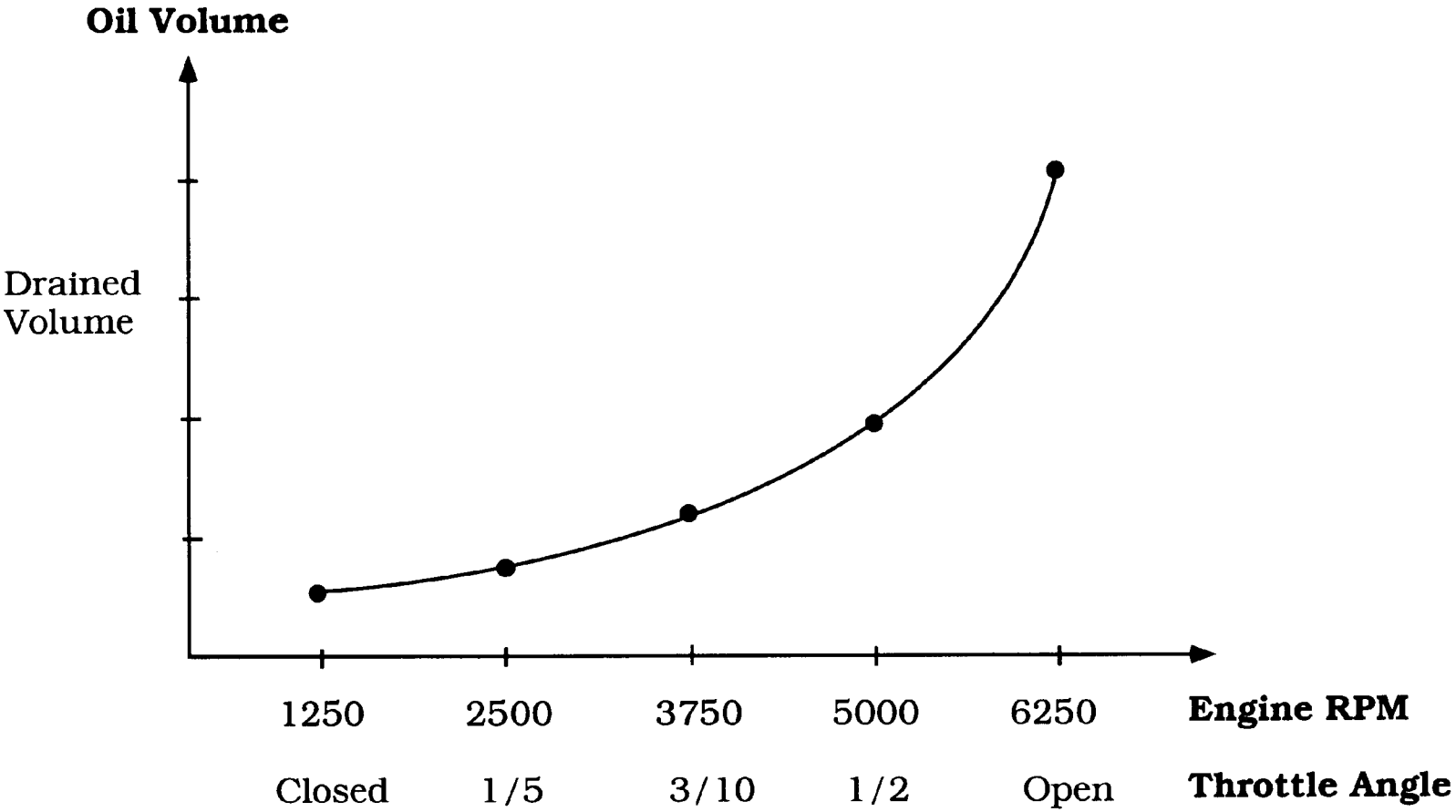
FIG. 4 is a graph illustrating the relationship of oil delivery volume to engine rpm and throttle valve angle for the oil supply system of the present invention.

FIG. 4 illustrates a drain oil or delivered oil volume to the engine 22 with respect to engine speed (i.e., the crankshaft speed in revolutions per minute) and the throttle opening angle. As illustrated, the oil delivery rate increases with increasing engine speed and throttle valve opening angle.

The oil volume which is supplied directly to the engine 22 through the pipe 170 may vary from the volume which is supplied to the engine 22 with the fuel. Preferably, the volume of the oil supplied directly through the pipe 170 exceeds that volume which is supplied with the fuel. In accordance with this embodiment of the invention, oil is delivered directly and indirectly (i.e., with fuel) to lubricate the exhaust system, including the water lock 124, and the throttle valve 90.

Figure 5:
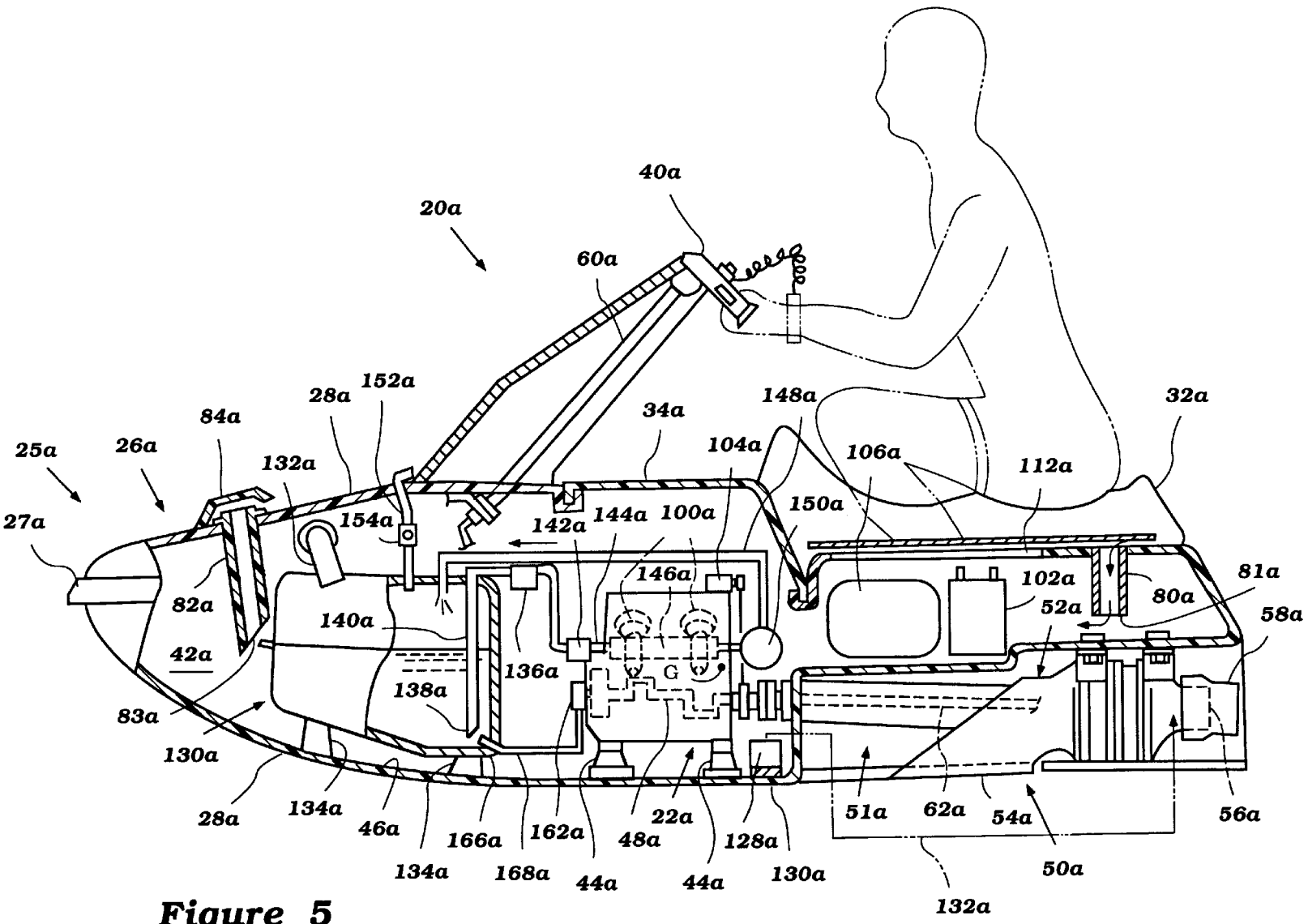
FIG. 5 is a cross-sectional side view of a watercraft powered by an engine and having an oil supply system in accordance with a second embodiment of the present invention.
Figure 6:
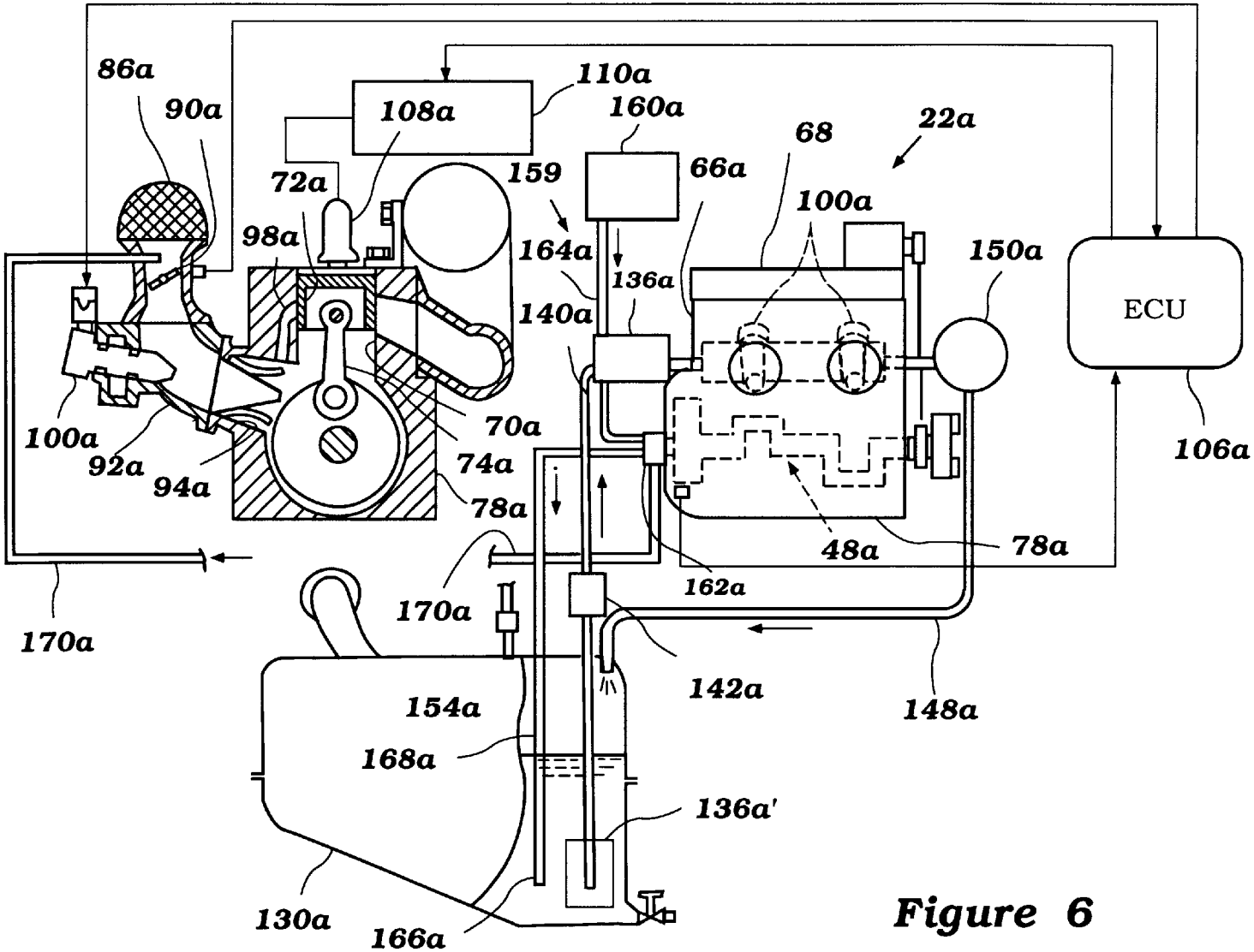
FIG. 6 is a schematic illustration of the oil supply system of the second embodiment of the present invention.

An oil supply system in accordance with a second embodiment of the present invention is illustrated in FIGS. 5 and 6. In this embodiment, like or similar parts have been given like reference numerals to those used in the description and illustration of the first embodiment, except that an "a" designator has been added to all of the reference numerals of this embodiment.

In this embodiment, an oil supply system 159*a* is provided similar to that described in the first embodiment.

As illustrated, each air inlet pipe 80*a*, 82*a* has an outlet 81*a*, 83*a* which is positioned within the engine compartment 42*a* some distance below the upper portion 28*a* of the hull 26*a*. In particular, each pipe 80*a*, 82*a* extends downwardly from the upper portion 28*a* towards the lower portion 30*a*.

The fuel pump 136*a* is positioned near the top of the fuel tank 130*a*, and in a position which is higher than the outlets 81*a*, 83*a* of the intake pipes 80*a*, 82*a* above the bottom surface 46*a* of the lower portion 30*a* of the hull 26*a*. In this position, the fuel pump 136*a* is protected from being exposed from water entering the engine compartment 42*a* through the intake pipes 80*a*, 82*a*. This prolongs the life of the pump 136*a*, which is susceptible to corrosion.

In an alternate arrangement of this embodiment, and as illustrated in FIG. 6, the fuel pump 136*a* may be positioned within the fuel tank 130*a* itself to protect it from corrosion.

An oil supply system in accordance with a third embodiment of the present invention is illustrated in FIGS. 7–10. In this embodiment, like or similar parts have been given like reference numerals to, those used in the description and illustration of the previous embodiments, except that a "b" designator has been added to all of the reference numerals of this embodiment.

In this embodiment, the fuel system includes a sub-fuel tank, preferably in the form of a vapor separator 180*b*. Fuel is drawn from a main or primary fuel tank 130*b* by a first fuel pump 182*a* and selectively delivered into the vapor separator 180*b*. Fuel flows through a delivery line 140*b* through a filter element 142*b* to the vapor separator 180*b*.

Preferably, a float-type valve 186*b* is positioned within the vapor separator 180*b* for controlling the flow of fuel through the line 140*b* to the separator 180*b*. This type of valve is well known to those of skill in the art, and is generally arranged so that when the separator 180*b* is full, a float 181*b* rises and a needle element 183 connected thereto closes the line 140*b*, and as the separator 180*b* empties, the float sinks, and the line 140*b* is opened, permitting fuel to flow into the separator 180*b*.

A second, high pressure pump 136*b* is positioned within the separator 180*b* and draws fuel therefrom and delivers it through a high pressure line 144*b* to the fuel rail 146*b*.

A vapor relief line 190*b* extends from the separator 180*b* Preferably, a roll-over valve 192*b* is positioned along the line 190*b*.

Fuel which is not delivered by the fuel injectors 100*b* is returned from the fuel rail 146*b* through a return line 148*b* to the vapor separator 180*b*.

The oil supply system is preferably arranged so that the oil pump 162*b* draws oil from the oil tank 160*b* and delivers it into the vapor separator 180*b*. Preferably, the oil is delivered near an intake 137*b* of the pump 136*b*. There the oil mixes with the fuel in the separator 180*b*, so that the high pressure pump 136*b* delivers a combined fuel and oil mixture. Oil is also delivered directly to the engine as in the first embodiment through line 170*b*. Oil which is pumped, but not supplied, may be returned to the oil tank 160*b* through a return line 163*b*.

Figure 7:
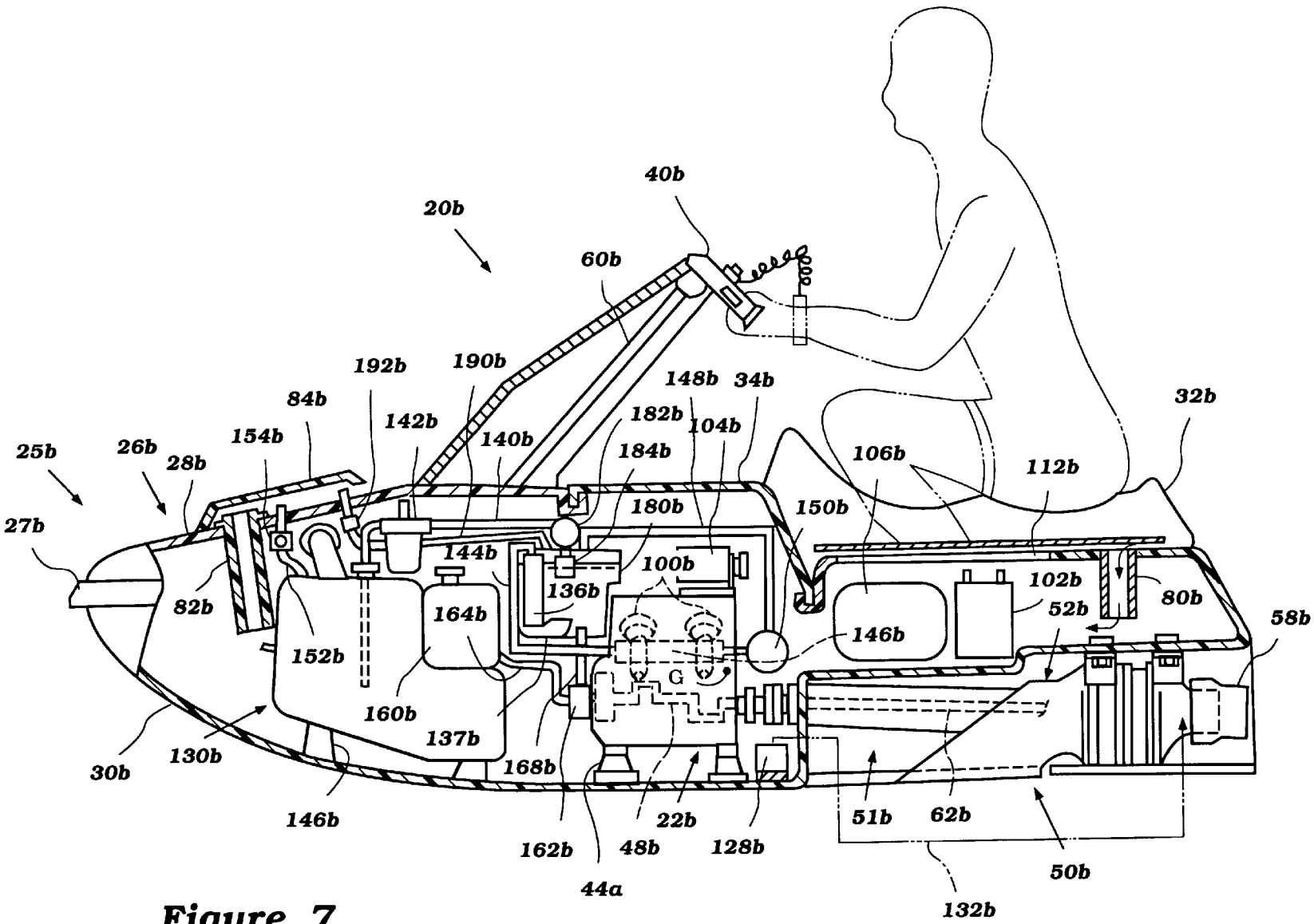
FIG. 7 is a cross-sectional side view of a watercraft powered by an engine and having an oil supply system in accordance with a third embodiment of the present invention.
Figure 8:
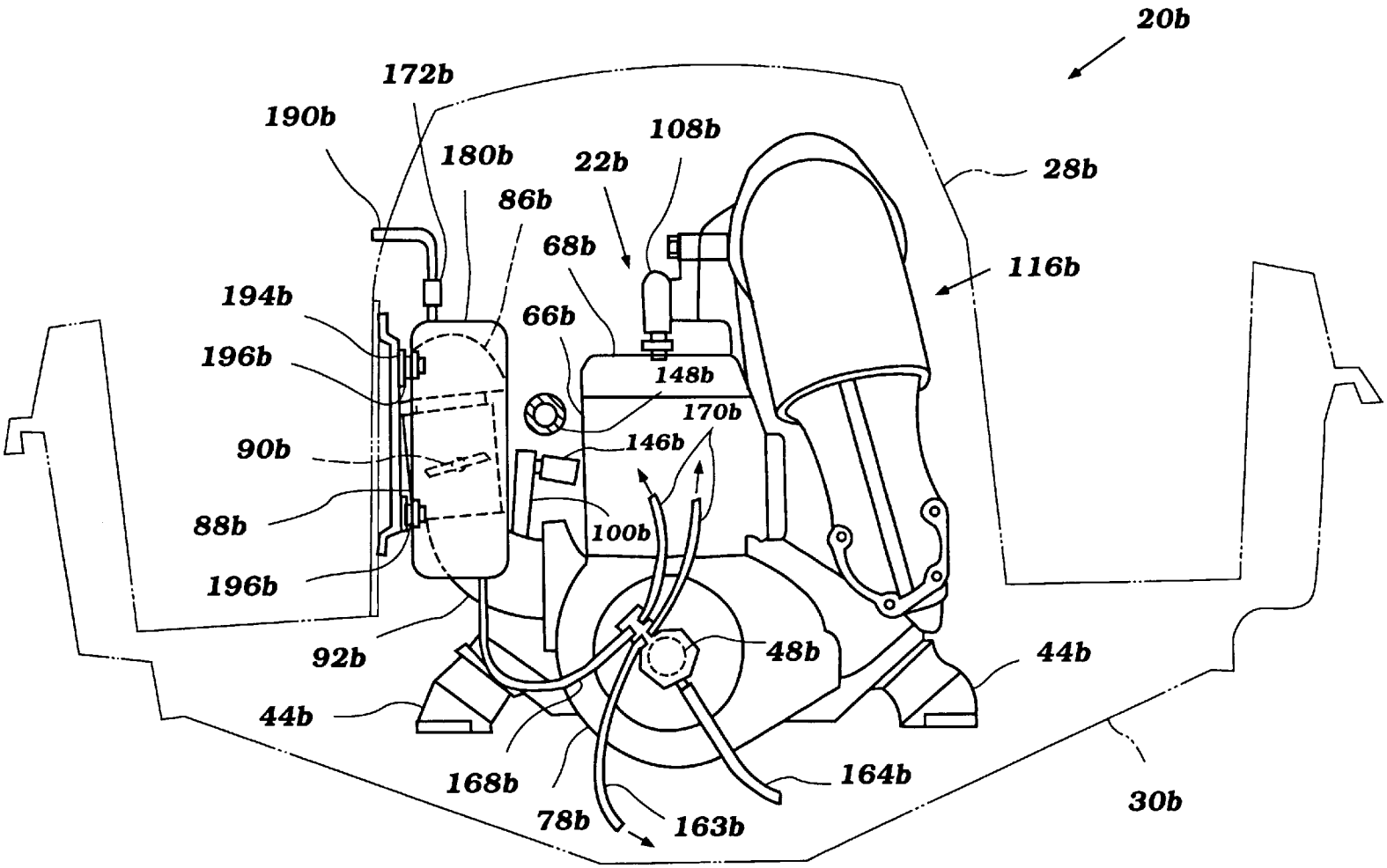
FIG. 8 is an end view of the engine of the watercraft illustrated in FIG. 7, with a hull of the watercraft illustrated in phantom.

As illustrated in FIG. 7, the oil tank 160*b* is preferably positioned in a recessed or indented section of the fuel tank 130*b*, providing for a compact arrangement and eliminating the need for separate oil and fuel tank mountings.

Figure 10:
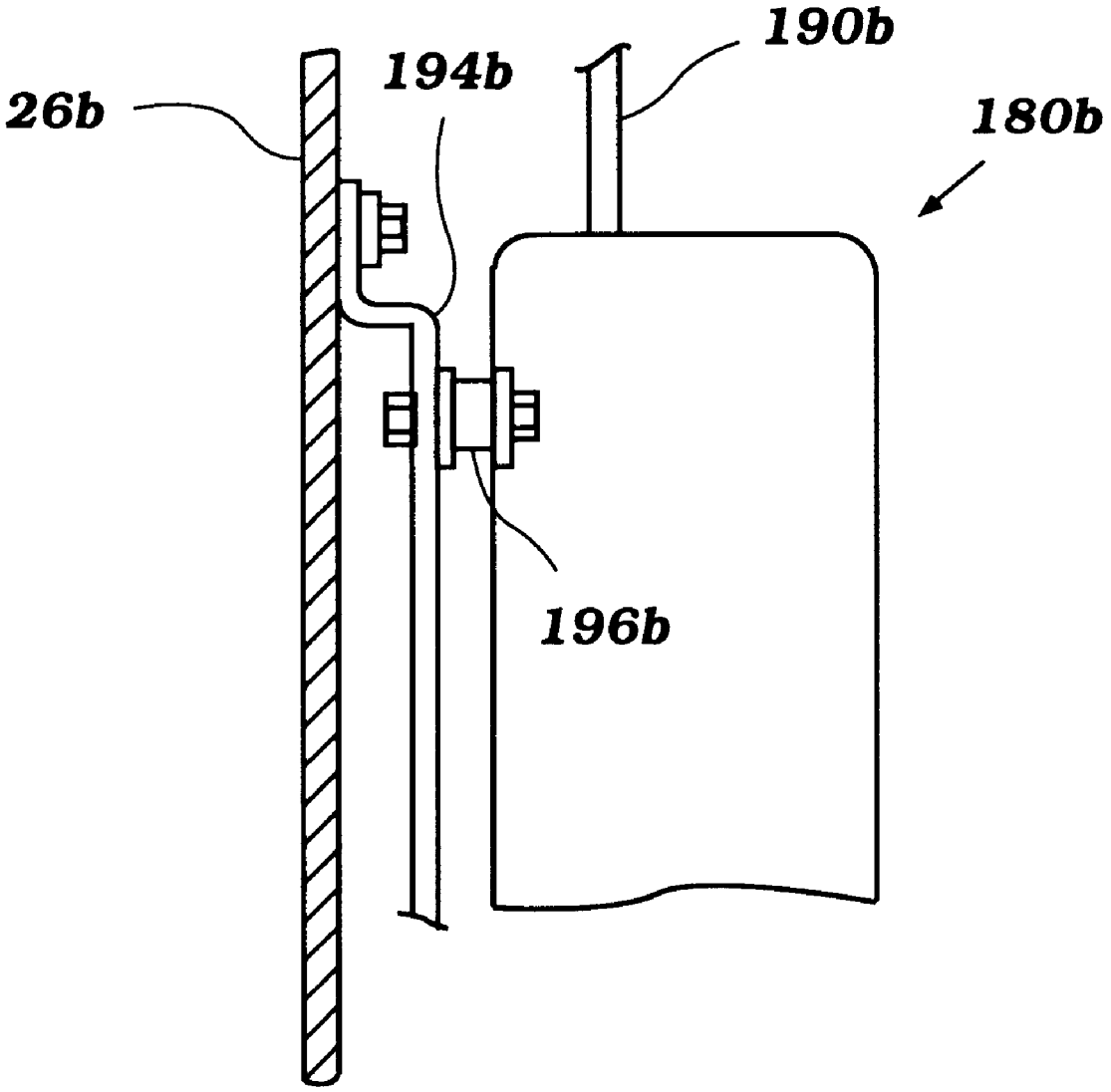
FIG. 10 is a cross-sectional view of a portion of a vapor separator of the oil supply system of the third embodiment of the invention connected to a hull of the watercraft.

A mounting for the vapor separator 180*b* is illustrated in FIG. 10. As illustrated therein, the separator 180*b* is preferably mounted to a side of the hull 26*b* within the engine compartment 42*b*. A mounting bracket 194*b* is connected to the hull 26*b* with one or more fasteners. The vapor separator 180*b* is connected to the bracket 194*b* with one or more fasteners through an elastomeric member 196*b*. For example, a rubber bushing may be positioned between the separator 180*b* and bracket 194*b* for dampening vibrations from the hull 28*b* to the separator 180*b*. This mounting serves to reduce agitation of the fuel within the separator 180*b*, reducing vapor production.

Figure 11:
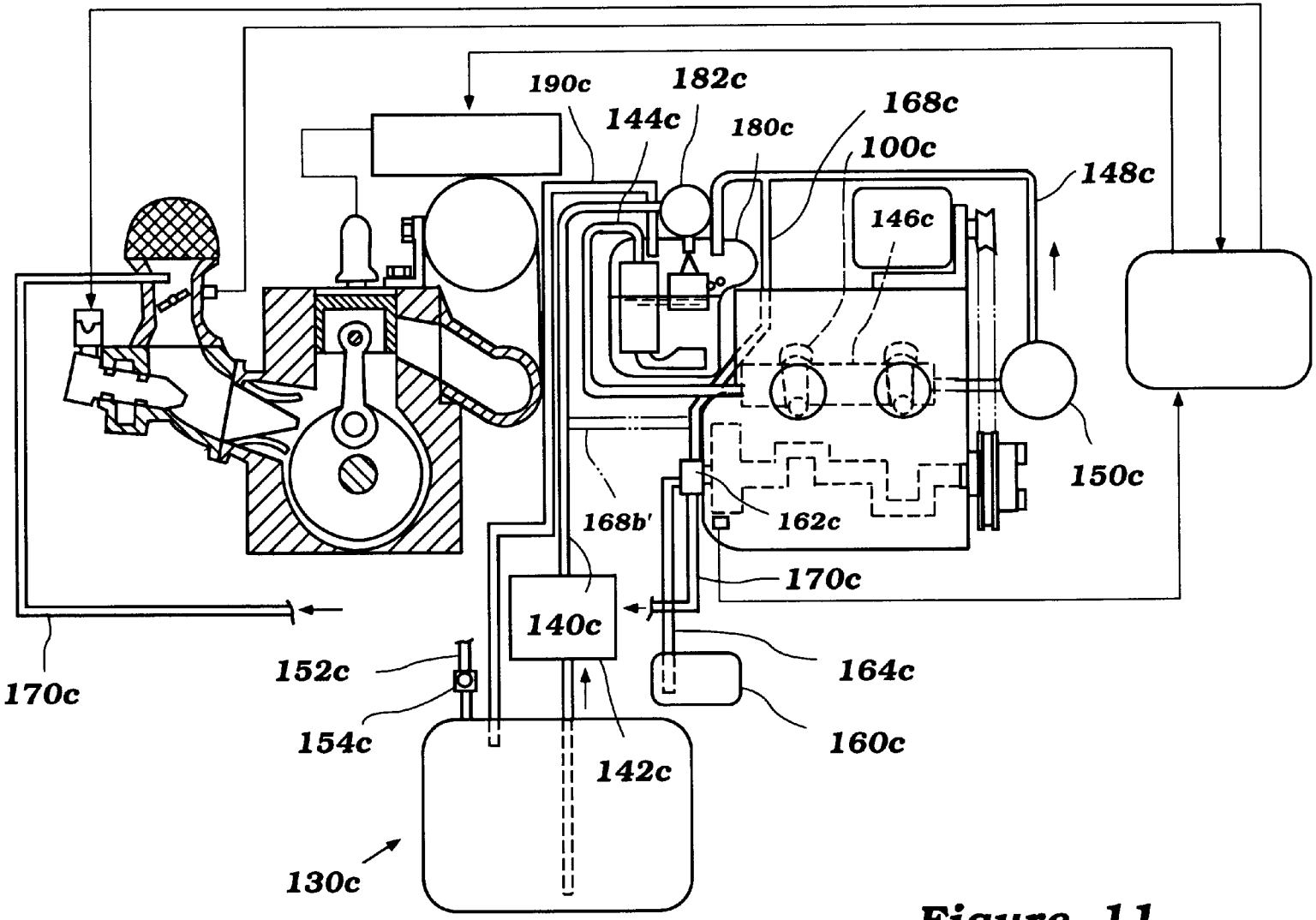
FIG. 11 is a schematic illustration of a fourth embodiment oil supply system in accordance with the present invention.

An oil supply system in accordance with a fourth embodiment of the present invention is illustrated in FIG. 11. In this embodiment, like or similar parts have been given like reference numerals to those used in the description and illustration of the previous embodiments, except that a "c" designator has been added to all of the reference numerals of this embodiment.

Figure 9:
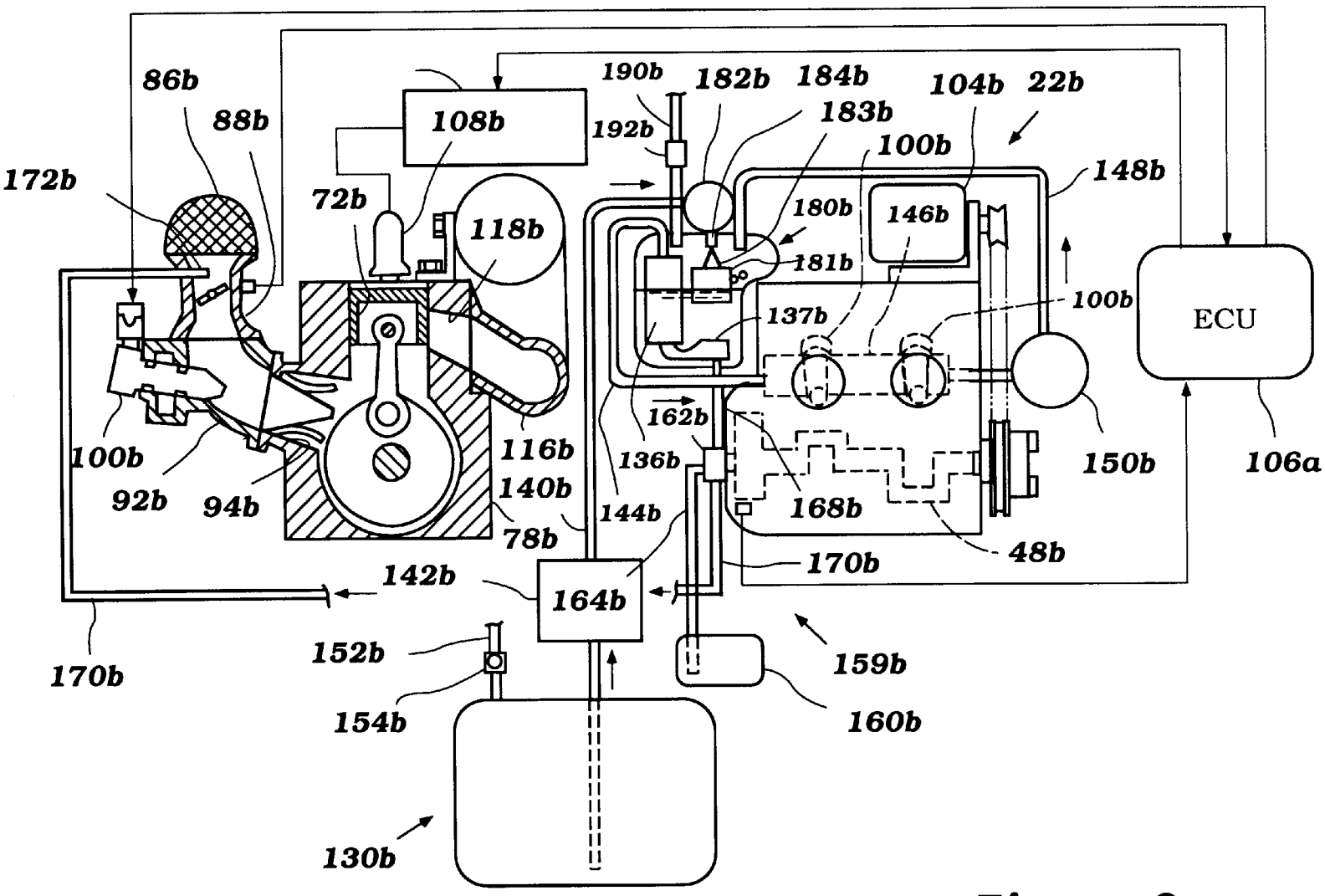
FIG. 9 is a schematic illustration of the oil supply system of the third embodiment of the present invention.

This embodiment of the invention is very similar to that illustrated in FIGS. 7–10, and most particularly to FIG. 9. In this embodiment, oil is delivered directly to the engine 22*c* through line 170*c*, and indirectly through the fuel through a line 168*c* which either extends to the fuel return line 148*c* or to the fuel delivery line 140*c* extending from the main fuel tank 130*c* to the vapor separator 180*c*.

In addition, the vapor relief line 190*c* which leads from the vapor separator 180*c* preferably terminates back at the fuel tank 130*c*, with the combined vapor from the separator 180*c* and tank 130*c* relieved through the line 152*c*.

Figure 12:
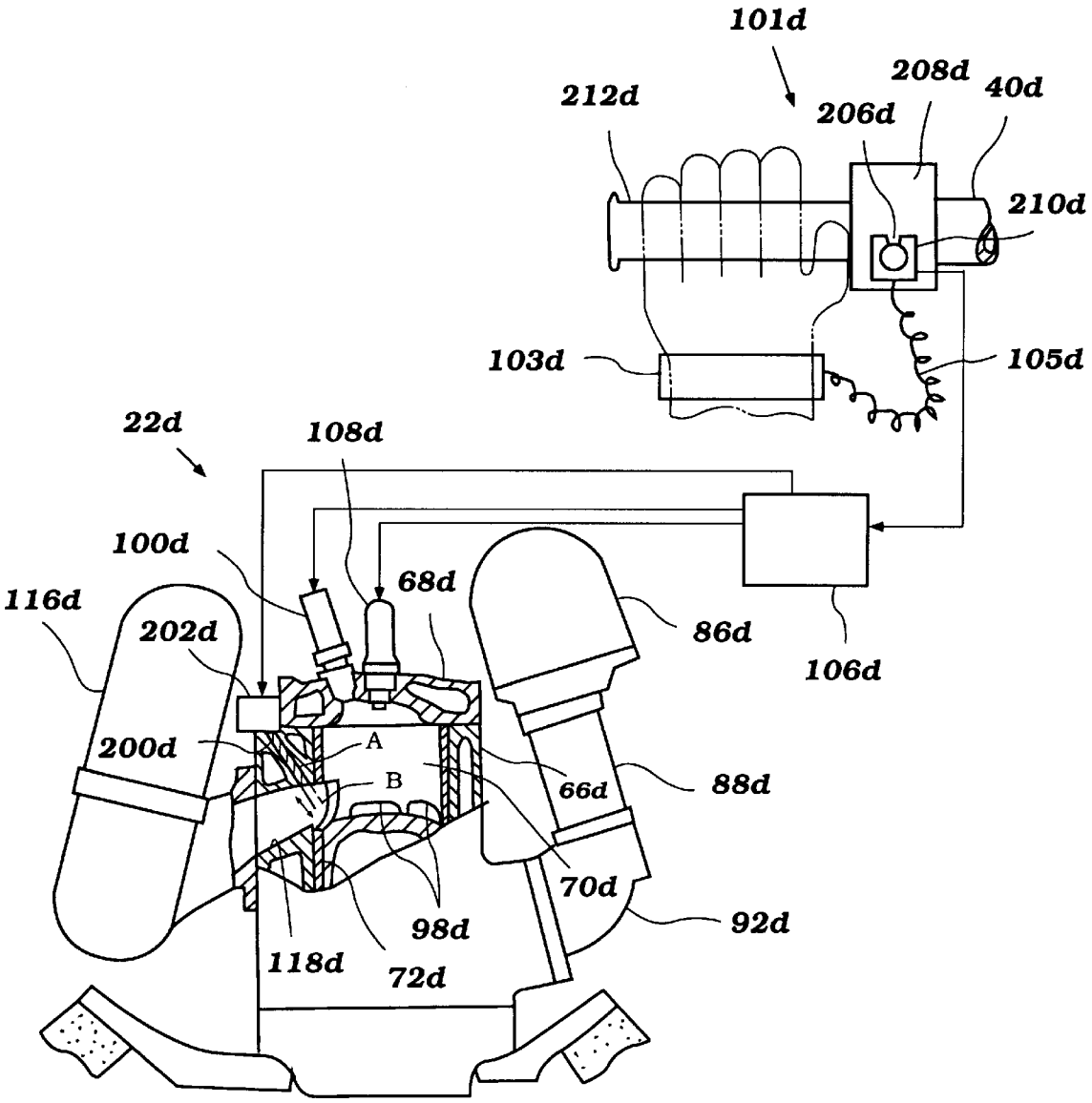
FIG. 12 is a schematic illustration of a fifth embodiment oil supply system in accordance with the present invention.

An oil supply system in accordance with a fifth embodiment of the present invention is illustrated in FIG. 12. In this embodiment, like or similar parts have been given like reference numerals to those used in the description and illustration of the previous embodiments, except that a "d" designator has been added to all of the reference numerals of this embodiment.

In this embodiment, the engine 22*d* preferably includes an oil supply system similar to that of one of the embodiments described and illustrated above. In addition, however, the engine 22*d* preferably includes an exhaust timing control valve 200*d*. In the embodiment illustrated, the valve 200*d* is a sliding knife type valve. The valve 200*d* may comprise a rotating valve or other types known to those of skill in the art.

The valve 200*d* is arranged to move between a first position "B" in which it extends into the exhaust passage 118*d* leading from the cylinder 70*d* to the exhaust manifold 116*d*, and a second position "A" in which the valve is generally retracted out of the passage 118*d*. The position of the valve 200*d* between the first and second positions controls the timing of the opening and closing of the exhaust passage 118*d*, as is known to those of skill in the art (i.e., the closer the valve 200*d* is to the first position, the earlier the passage 118*d* closes as the piston moves up, and the later it opens on the way down).

Means are provided for moving the valve 200*d*. Preferably, this means comprises an electrically-powered motor 202*d*. This motor 202*d* is operated by the ECU 106*d* in accordance with an exhaust timing control strategy.

A lanyard switch 101*d* is also illustrated in detail. The switch 101*d* includes a post 206*d* which extends from a support 208*d* connected to the steering handle 40*d*. The switch 101*d* is positioned near a throttle control 212*d* at an end of the handle 40*d*.

A connector 210*d* which is connected to the cord 105*d* is selectively connected to the post 206*d*. When the connector 210*d* is connected, the switch is closed and the power circuit is energized, as described in more detail in conjunction with the first embodiment. When the connector 210*d* is disconnected from the post 206*d*, the switch is opened and power is prevented from flowing through the circuit.

In accordance with this embodiment, when the switch is opened, for example when the operator falls from the craft 20, or when the operator shuts of the engine 22 by disconnecting the connector 210*d*, the ECU 106*d* is arranged to close the exhaust timing valve 200*d*. In its extended ("B") position the valve 200*d* acts to generally prevent the flow of exhaust or water which may enter the exhaust system upstream of the water lock, into the cylinder 70*d* protecting the cylinder 70*d* and other internal portions of the engine 22*d*.

Figure 13:
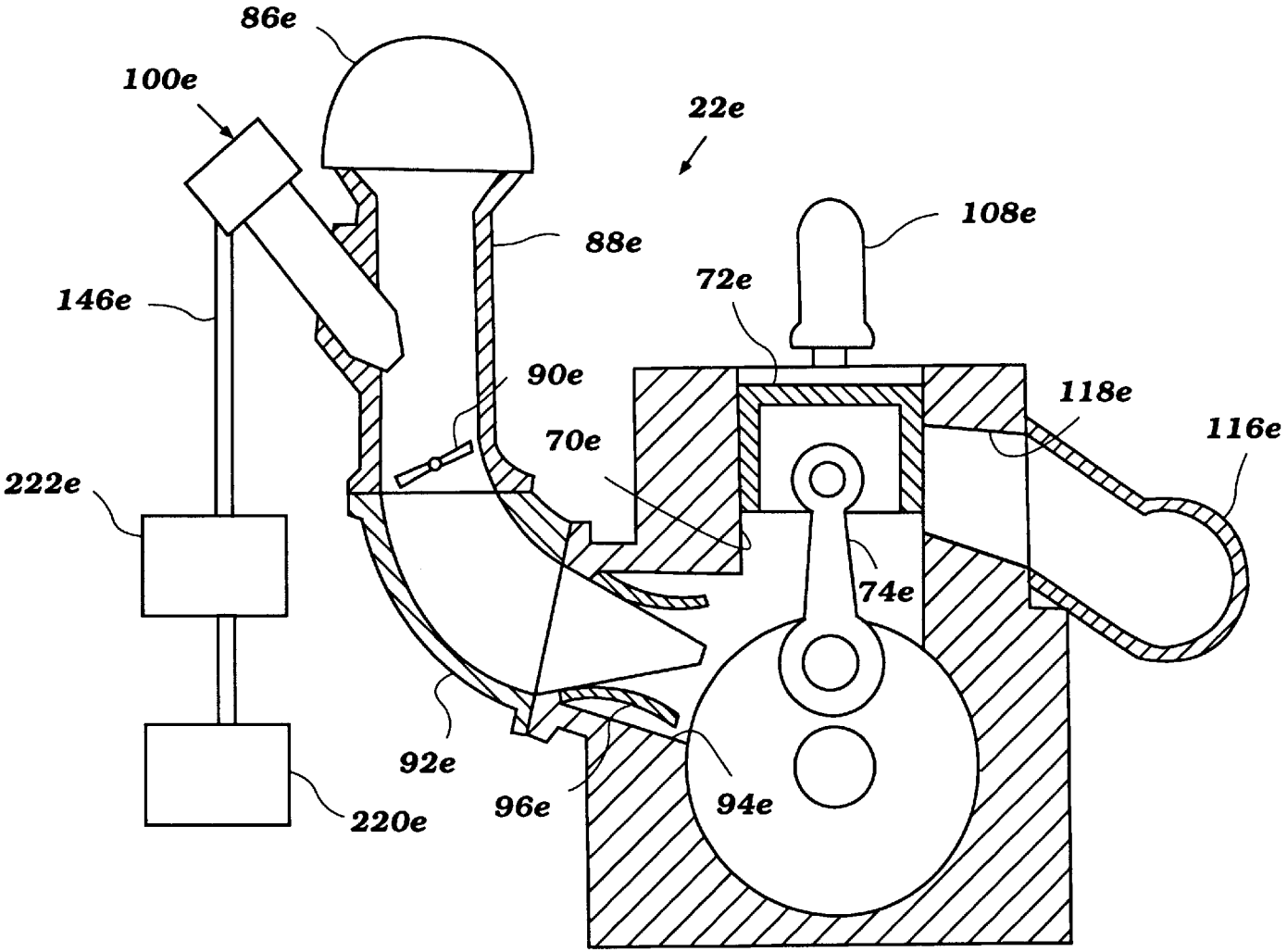
FIG. 13 is a cross-sectional view of an engine having an oil supply system in accordance with a sixth embodiment of the present invention.
Figure 14:
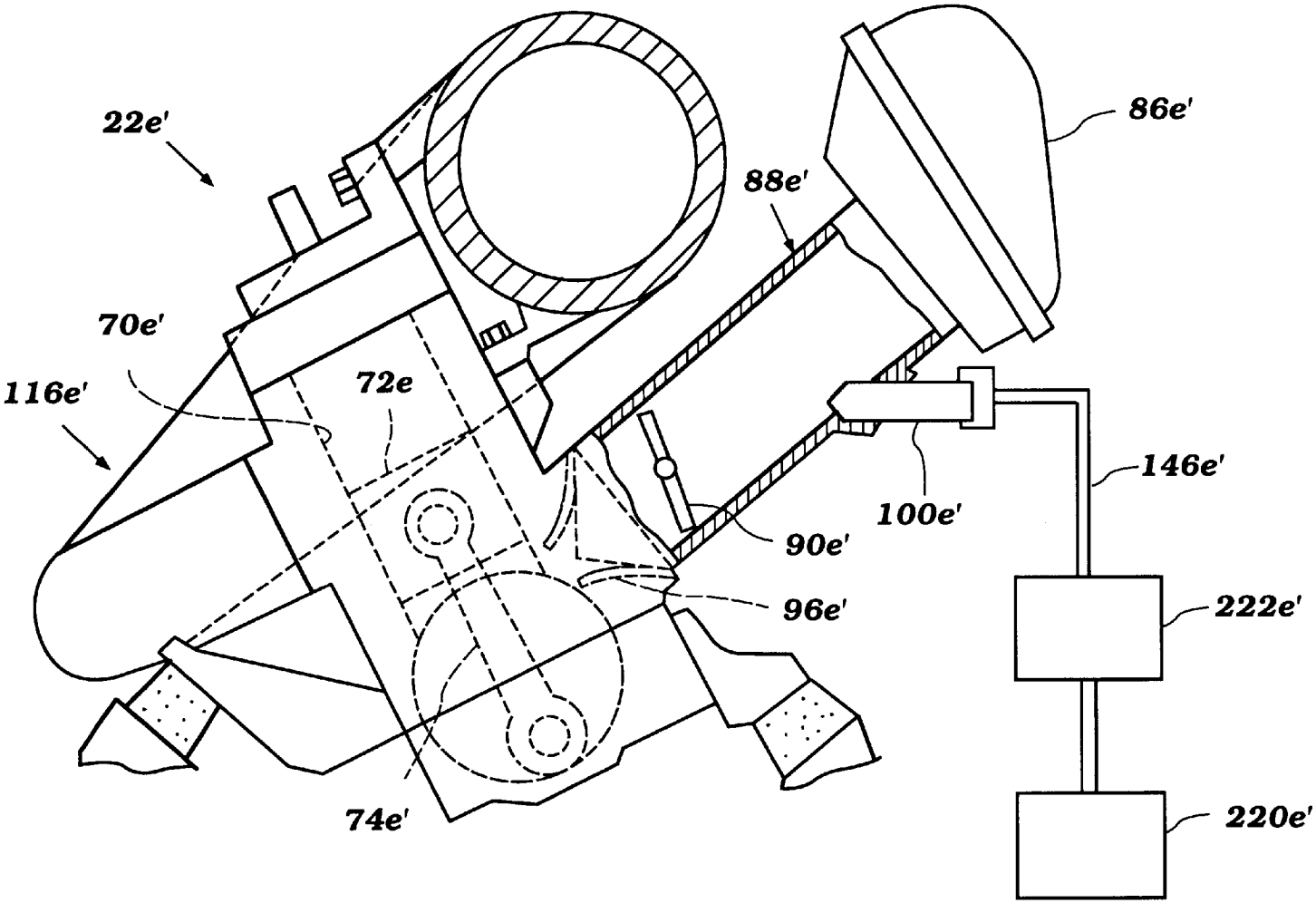
FIG. 14 is a cross-sectional view of an engine having an oil supply system in accordance with the sixth embodiment of the present invention, the engine arranged in an inclined arrangement.

An oil supply system in accordance with a sixth embodiment of the present invention is illustrated in FIGS. 13–14. In this embodiment, like or similar parts have been given like reference numerals to those used in the description and illustration of the previous embodiments, except that an "e" designator has been added to all of the reference numerals of this embodiment.

In this embodiment, the engine 22*e* is arranged so that its cylinders 70*e* are vertically extending. The oil supply system is arranged so that oil is supplied to engine 22*e* with just the fuel (and not also separately or directly, as in the previous embodiments). In particular, oil is supplied from an oil supply 220*e* to a fuel supply 222*e* (such as with an oil pump through an oil line from an oil tank). The combined mixture of oil and fuel is then supplied through a fuel rail 146*e* to a fuel injector 100*e* (such as by a high pressure fuel pump).

Preferably, the fuel injector 100*e* is arranged to deliver the oil and fuel mixture upstream of the throttle valve 90*e*. In this manner, oil is sprayed onto the throttle valve 90*e* to lubricate it.

FIG. 14 illustrates use of such an oil supply system with an engine 22*e*' in which the cylinders 70*e*' are tilted or offset from vertical. In this arrangement, the throttle body 88*e*' extends at an angle also offset from vertical (contra to the embodiment illustrated in FIG. 13). Again, a combined oil and fuel mixture is delivered to the throttle body 88*e*' upstream of the throttle valve 90*e*' by a fuel injector 100*e'*.

In the embodiments illustrated, the fuel injectors 100 are arranged to deliver fuel into the air passing through the intake pipe or throttle body. Those of skill in the art will appreciate that the fuel may be delivered directly into the crankcase chamber, a scavenge passage or the like.

Of course, the foregoing description is that of preferred embodiments of the invention, and various changes and modifications may be made without departing from the spirit and scope of the invention, as defined by the appended claims.

What is claimed is:

1. An arrangement for reducing the backflow of water vapor into a cylinder of an engine through an exhaust system routing exhaust from said engine to a discharge and including a waterlock along said exhaust system between said engine and said discharge, said engine mounted to a hull of a watercraft and having an output shaft arranged to power a water propulsion device of said watercraft, said engine having at least one cylinder and a fuel injector for supplying fuel to said engine, said arrangement including an exhaust control valve positioned along said exhaust system moveable between a first position in which a portion of an exhaust path at said location of said valve is partially obscured, and a second positioned in which said exhaust path at said location is less obscured than when said valve is in said first position, said valve moveable between said first and second positions dependent upon an operating condition of said engine, and means for moving said exhaust control valve to said first position when said engine is stopped for assisting in assuring against water entry through said exhaust passage.

2. The arrangement in accordance with claim 1, wherein said fuel injector supplies fuel directly into said cylinder, into air intake system of said engine, or to a crankcase chamber or scavenge passage of said engine.

3. The arrangement in accordance with claim 1, wherein said operating condition comprises engine speed.

4. The arrangement in accordance with claim 1, wherein said valve comprises a sliding-knife type valve.

5. The arrangement in accordance with claim 1, wherein said fuel injector includes a valve for controlling the flow of fuel therethrough.

* * * * *